US009585804B2

(12) United States Patent
Heimbrock et al.

(10) Patent No.: US 9,585,804 B2
(45) Date of Patent: Mar. 7, 2017

(54) ACCESSORY FRAME ATTACHMENT APPARATUS

(71) Applicant: Hill-Rom Services, Inc., Batesville, IN (US)

(72) Inventors: Richard H. Heimbrock, Cincinnati, OH (US); Edward J. Koors, Indianapolis, IN (US); Jonathan D. Turner, Dillsboro, IN (US); David W. Hornbach, Brookville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/299,202

(22) Filed: Jun. 9, 2014

(65) Prior Publication Data

US 2014/0331410 A1 Nov. 13, 2014

Related U.S. Application Data

(63) Continuation of application No. 13/362,588, filed on Jan. 31, 2012, now Pat. No. 8,756,735.

(60) Provisional application No. 61/440,607, filed on Feb. 8, 2011.

(51) Int. Cl.

| | |
|---|---|
| ***A61G 7/053*** | (2006.01) |
| ***A61G 7/16*** | (2006.01) |
| ***A61G 7/015*** | (2006.01) |
| *A61G 7/05* | (2006.01) |
| *A61G 7/012* | (2006.01) |

(52) U.S. Cl.

CPC ..... *A61G 7/053* (2013.01); *A61G 7/015* (2013.01); *A61G 7/0533* (2013.01); *A61G 7/16* (2013.01); *A61G 7/012* (2013.01); *A61G 7/0503* (2013.01)

(58) Field of Classification Search

CPC ..... A61G 7/053; A61G 7/015; A61G 7/16; A61G 7/0533; A61G 7/012; A61G 2007/0514; A61G 2007/0524; A61G 7/0503

USPC ..... 5/662, 602, 428, 425, 600, 601, 83.1, 5/85.1, 87.1, 286

See application file for complete search history.

(56) References Cited

U.S. PATENT DOCUMENTS

| | | | |
|---|---|---|---|
| 421,656 | A | 2/1890 | Blanken |
| 841,560 | A | 1/1907 | Morris |
| 1,699,026 | A | 1/1929 | Schumacher et al. |
| 2,585,660 | A | 2/1952 | Kjos et al. |
| 2,722,017 | A | 11/1955 | Burst et al. |

(Continued)

FOREIGN PATENT DOCUMENTS

| | | |
|---|---|---|
| AU | 591951 B2 | 12/1989 |
| CA | 2 293 085 A1 | 6/2001 |

(Continued)

*Primary Examiner* — David E Sosnowski
*Assistant Examiner* — Myles Throop
(74) *Attorney, Agent, or Firm* — Barnes & Thornburg LLP

(57) ABSTRACT

A patient helper apparatus for use with a patient support is disclosed. The patient helper apparatus includes a first L-shaped support tube coupled to the patient support, a shaft coupled to the first L-shaped support tube and extending over the patient support, and an egress handle coupled to the first L-shaped support tube. The egress handle moves between a stowed position and an assist position. In the stowed position, the egress handle is situated inside a footprint of the patient support. In the assist position, the egress handle extends outside the footprint of the patient support.

20 Claims, 10 Drawing Sheets

(56) References Cited

U.S. PATENT DOCUMENTS 2,817,854 A 12/1957 Pratt
2,817,855 A 12/1957 Pratt
3,021,534 A 2/1962 Hausted
3,055,020 A 9/1962 Mann
3,077,613 A 2/1963 Mayer
3,249,387 A 5/1966 Pivacek
3,286,283 A 11/1966 Bertoldo
3,312,986 A 4/1967 Fahrni et al.
3,344,445 A 10/1967 Crawford
3,351,962 A 11/1967 Dodrill et al.
3,486,176 A 12/1969 Murcott
3,565,380 A 2/1971 Langren
3,585,659 A 6/1971 Burst et al.
3,585,992 A 6/1971 Vessels
3,606,450 A * 9/1971 Sedgwick ..... A47C 7/68 108/129
3,654,921 A 4/1972 Neuhardt, Jr.
3,699,953 A 10/1972 Mason
3,734,088 A 5/1973 Tucker, Jr. et al.
3,765,411 A 10/1973 Ward, Jr.
3,766,912 A 10/1973 Daniels
3,800,787 A 4/1974 Rush
3,850,165 A 11/1974 Throner
3,856,003 A 12/1974 Pfluger
3,865,434 A 2/1975 Sully
3,932,903 A 1/1976 Adams et al.
3,943,524 A 3/1976 Sample
3,971,083 A 7/1976 Peterson
4,002,330 A 1/1977 Johansson
4,120,530 A 10/1978 Imbro
4,144,880 A 3/1979 Daniels
4,190,224 A 2/1980 LeBlanc et al.
4,202,062 A 5/1980 Marcyan
4,236,265 A 12/1980 Carradine
4,247,091 A * 1/1981 Glowacki ..... A61G 13/0009 5/602
4,253,207 A 3/1981 Marcyan
4,340,984 A 7/1982 Marcyan
4,390,011 A * 6/1983 Evans ..... A61B 19/28 108/6
4,439,880 A 4/1984 Koncelik et al.
4,489,713 A 12/1984 Latenser
4,551,872 A 11/1985 Reed
4,593,422 A 6/1986 Wolpert, Jr. et al.
4,612,679 A 9/1986 Mitchell
4,615,058 A * 10/1986 Feldt ..... A61G 13/0009 5/181
4,616,637 A 10/1986 Caspari et al.
4,642,824 A 2/1987 Hodges
4,648,144 A 3/1987 Rose
4,680,790 A 7/1987 Packard et al.
4,730,606 A 3/1988 Leininger
4,747,171 A 5/1988 Einsele et al.
4,839,933 A 6/1989 Plewright et al.
4,847,930 A 7/1989 Spath
4,887,325 A 12/1989 Tesch
4,932,090 A 6/1990 Johansson
4,993,089 A 2/1991 Solomon et al.
5,010,880 A 4/1991 Lamb
5,027,799 A 7/1991 Laico et al.
5,038,430 A 8/1991 Bly
5,039,056 A 8/1991 Paxton
5,060,327 A 10/1991 Celestina et al.
5,083,430 A 1/1992 Hirata et al.
5,084,925 A 2/1992 Cook
5,149,036 A 9/1992 Sheehan
5,195,200 A 3/1993 Leoutsakos
D336,578 S 6/1993 Celestina
5,214,812 A * 6/1993 Bartow ..... A61G 13/0009 5/602
5,216,768 A 6/1993 Bodine et al.
5,225,403 A 7/1993 Treiber et al.
5,231,721 A 8/1993 Fish
5,255,403 A 10/1993 Ortiz
5,312,077 A 5/1994 Gutierrez
5,335,385 A 8/1994 Brown
5,337,430 A 8/1994 Schlein
5,347,682 A 9/1994 Edgerton, Jr.
5,358,205 A 10/1994 Starkey et al.
5,381,571 A 1/1995 Gabhart
5,384,927 A 1/1995 Mardero et al.
5,388,294 A 2/1995 Reeder
5,394,581 A 3/1995 Leoutsakos
5,400,450 A * 3/1995 Leoutsakos ..... A61G 7/053 5/426
5,401,236 A 3/1995 Summerville
5,418,988 A 5/1995 Iura
5,453,756 A 9/1995 Lowrey
5,485,699 A 1/1996 Gabhart
5,542,136 A 8/1996 Tappel
5,542,138 A 8/1996 Williams et al.
5,555,582 A * 9/1996 Jerideau ..... A61G 5/006 5/600
5,586,352 A 12/1996 O'Brien et al.
5,588,166 A 12/1996 Burnett
5,657,884 A 8/1997 Zilincar, III
5,662,591 A 9/1997 Peindl et al.
5,676,158 A 10/1997 Katzman et al.
5,678,267 A 10/1997 Kinder
5,689,839 A 11/1997 Langaniere
5,715,548 A * 2/1998 Weismiller ..... A61G 7/002 5/611
5,781,945 A 7/1998 Scherer et al.
5,787,530 A 8/1998 Brix
5,802,636 A 9/1998 Corbin et al.
5,806,111 A 9/1998 Heimbrock et al.
5,806,117 A 9/1998 Gotfried
5,832,549 A 11/1998 Le Pallec et al.
5,836,026 A 11/1998 Reed
5,878,452 A 3/1999 Brooke et al.
6,058,531 A 5/2000 Carroll
6,141,806 A 11/2000 Bobey et al.
6,185,767 B1 2/2001 Brooke et al.
6,216,293 B1 4/2001 Ruschke
6,240,583 B1 6/2001 Brooke et al.
6,289,539 B1 * 9/2001 Alpern ..... A47C 21/08 5/659
6,290,194 B1 9/2001 Chaconas et al.
6,397,416 B2 6/2002 Brooke et al.
6,619,598 B2 * 9/2003 De Miranda ..... A61B 19/28 248/118.3
6,668,402 B2 12/2003 Heimbrock
6,725,474 B2 4/2004 Foster et al.
6,728,985 B2 5/2004 Brooke et al.
7,039,971 B2 5/2006 Sebastien
7,062,804 B2 6/2006 Rouse et al.
7,376,992 B2 5/2008 Salt et al.
7,383,849 B2 6/2008 Kline
7,523,514 B2 4/2009 Salt et al.
7,536,738 B2 5/2009 Richards et al.
7,568,247 B2 8/2009 Strobel et al.
7,591,034 B2 * 9/2009 Kramer ..... A61G 7/05 5/425
7,690,056 B2 4/2010 Moffa et al.
8,661,585 B1 * 3/2014 Alasfour ..... A61G 7/015 5/604
2001/0027578 A1 10/2001 Brooke et al.
2004/0133980 A1 * 7/2004 Coppens ..... A61B 6/0442 5/601
2005/0120485 A1 6/2005 Sebastien
2008/0172791 A1 * 7/2008 Walczyk ..... A61G 13/12 5/623
2009/0229049 A1 * 9/2009 Heimbrock ..... A61G 7/015 5/425
2010/0064442 A1 3/2010 Riehm et al.
2012/0198631 A1 8/2012 Heimbrock et al.

(56) References Cited

U.S. PATENT DOCUMENTS

| | | | | |
|---|---|---|---|---|
| 2014/0047641 | A1* | 2/2014 | Thodupunuri | A61G 7/002 5/613 |

FOREIGN PATENT DOCUMENTS

| | | | |
|---|---|---|---|
| DE | 362892 | | 11/1922 |
| EP | 0610664 | | 8/1994 |
| EP | 1 364 635 | A1 | 11/2003 |
| WO | WO 82/02832 | | 9/1982 |
| WO | WO 01/47340 | | 7/2001 |
| WO | WO 2004/060257 | | 7/2004 |
| WO | WO 2006/010160 | A2 | 1/2006 |

* cited by examiner

ACCESSORY FRAME ATTACHMENT APPARATUS

CROSS-REFERENCE TO RELATED APPLICATIONS

The present application is a continuation of U.S. application Ser. No. 13/362,588, which was filed Jan. 31, 2012, now U.S. Pat. No. 8,756,735, which claims the benefit, under 35 U.S.C. §119(e), of U.S. Provisional Application No. 61/440,607, which was filed Feb. 8, 2011 and which is hereby incorporated by reference herein.

BACKGROUND OF THE INVENTION

The present disclosure is related to the arrangement and operation of a patient helper at a patient support. More specifically, the present disclosure is related to the a patient helper apparatus with a patient assist handle.

Patient helpers known in the art provide a shaft supported over a patient support such as a hospital bed. Some patient helpers are used in conjunction with triangular grab bars or traction devices that hang down from the patient helper shaft. Patient helpers are known to be removable from the patient support for storage when not in use.

In the prior art, patient helpers included shafts cantilevered over a patient support with triangular grab bars hanging from the shaft so that a patient could pull themselves up while on the patient support. Such patient helpers and grip handles did not provide support for a patient outside the footprint of the patient support. Additionally, such patient helper shafts could easily deflect when a force was applied to the cantilevered shaft

SUMMARY OF THE INVENTION

The present application discloses one or more of the features recited in the appended claims and/or the following features which, alone or in any combination, may comprise patentable subject matter:

According to the present disclosure, a patient helper apparatus may include a first L-shaped support tube coupled to the patient support, a shaft coupled to the first L-shaped support tube and extending over the patient support, and an egress handle coupled to the first L-shaped support tube. The egress handle may move between a stowed position, situated inside a footprint of the patient support viewed from a top plan view, and an assist position, extending outside a footprint of the patient support viewed from a top plan view.

In some embodiments, the egress handle may be pivotably coupled to the first L-shaped support tube for movement relative to the first L-shaped support tube about a first axis. The egress handle may be L-shaped and is sized to nest with the L-shaped support tube when the egress handle is in the stowed position.

The patient helper apparatus may include a handle positioning block coupled to the first L-shaped support tube. The handle positioning block may be situated between the first pivot axis and the patient support. Also, the handle positioning block may be configured to engage the egress handle when the egress handle is moved to the assist position.

It is contemplated that the patient helper apparatus may include a handle lock movable between a locked position and a release position. In the locked position, the handle lock may block the egress handle from moving relative to the first L-shaped support tube. In the release position, the handle lock may allow the egress handle to move relative to the first L-shaped support tube. The handle lock may include a first tab pivotably coupled to the first L-shaped support tube for movement relative to the first L-shaped support tube about a second axis. The egress handle may be pivotably coupled to the first L-shaped support tube for movement relative to the first L-shaped support tube about a first axis, the first axis being substantially perpendicular to the second axis. The handle lock may include a second tab pivotably coupled to the first L-shaped support tube for movement relative to the first L-shaped support tube about the second axis.

In some embodiments, the patient helper apparatus may include a second L-shaped support tube coupled to the patient support. The shaft may be coupled to the second L-shaped support tube. The egress handle may be moved away from the second L-shaped support tube when the egress handle is moved from the stowed position to the assist position.

A patient helper apparatus may be used with a patient support having a head end, a foot end, a first side, and a second side. The patient helper apparatus may include a first L-shaped support tube coupled to the patient support along the first side of the patient support, a second L-shaped support tube coupled to the patient support along the second side of the patient support at the head end of the patient support, and a shaft located above the patient support. The shaft may be coupled to the first L-shaped support tube and the second L-shaped support tube. The shaft may extend from the head end of the patient support toward the foot end of the patient support between the first side and the second side of the patient support. In some embodiments, the shaft may be located mid-way between the first side and the second side of the patient support.

The first L-shaped support tube may include a first coupler forming a first coupler duct and the shaft may extend through the first coupler duct. The second L-shaped support tube may include a second coupler forming a second coupler duct and the shaft may extend through the second coupler duct.

It is contemplated that the patient helper apparatus may include an egress handle coupled to the first support tube. The egress handle may pivot relative to the first L-shaped support tube between a stowed position and an assist position. In the stowed position, the egress handle may be a first distance from the second L-shaped support tube. In the assist position, the egress handle may be a second distance from the second L-shaped support tube. The second distance may be greater than the first distance.

A patient helper apparatus may be used with a patient support. The patient helper apparatus may include a first support tube coupled to the patient support at a first side of the patient support, a second support tube coupled to the patient support along a head end of the patient support, a shaft coupled to the first L-shaped support tube and the second support tube, the shaft extending over the patient support, and an egress handle coupled to the first support tube. The egress handle may extend from the first support tube in the direction of a foot end of the patient support and may terminate beyond the foot end of the patient support. In some embodiments, the first support tube and the second support tube may be L-shaped. It is contemplated that the first support tube may be spaced apart from the head end of the patient support and the second support tube may be coupled to the patient support at a second side of the patient support.

Additional features, which alone or in combination with any other feature(s), including those listed above and those listed in the claims may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
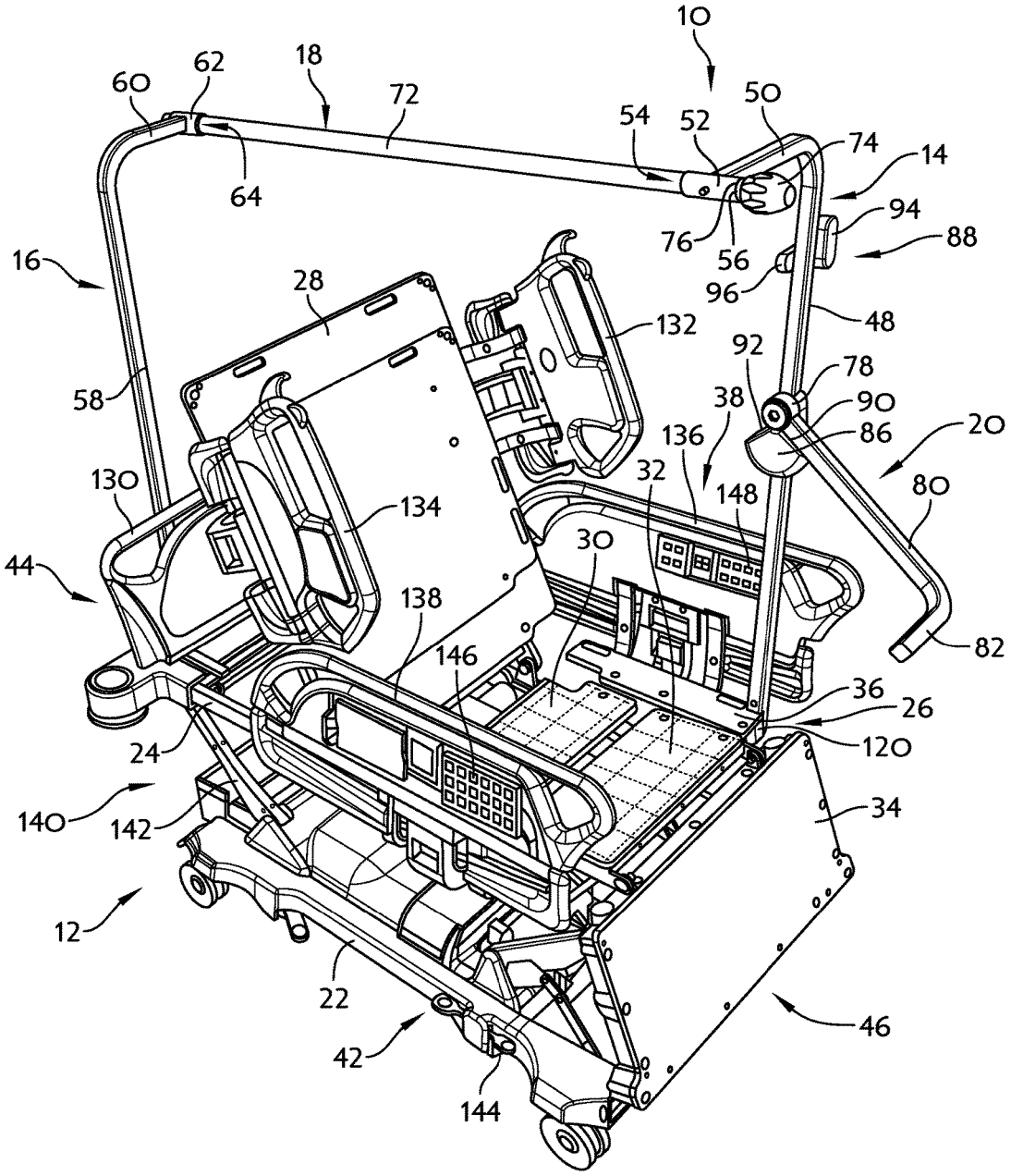
FIG. 1 is a perspective view of the patient helper of the present disclosure coupled to a patient support, the patient helper including an egress handle in an assist position, extending beyond a foot end of the patient support.

A patient helper apparatus 10 is shown in FIG. 1 coupled to a patient support. The patient support is illustratively embodied as a hospital bed 12 moved to a chair egress position. Patient helper 10 includes a first support tube 14, a second support tube 16, a shaft 18, and an egress handle 20. Shaft 18 is positioned over bed 12 so that grip bars, traction devices, and the like can be hung down from shaft 18 and used to support a patient. A triangular grab bar 25 is shown hanging from shaft 18 in FIG. 7.

Figure 2:
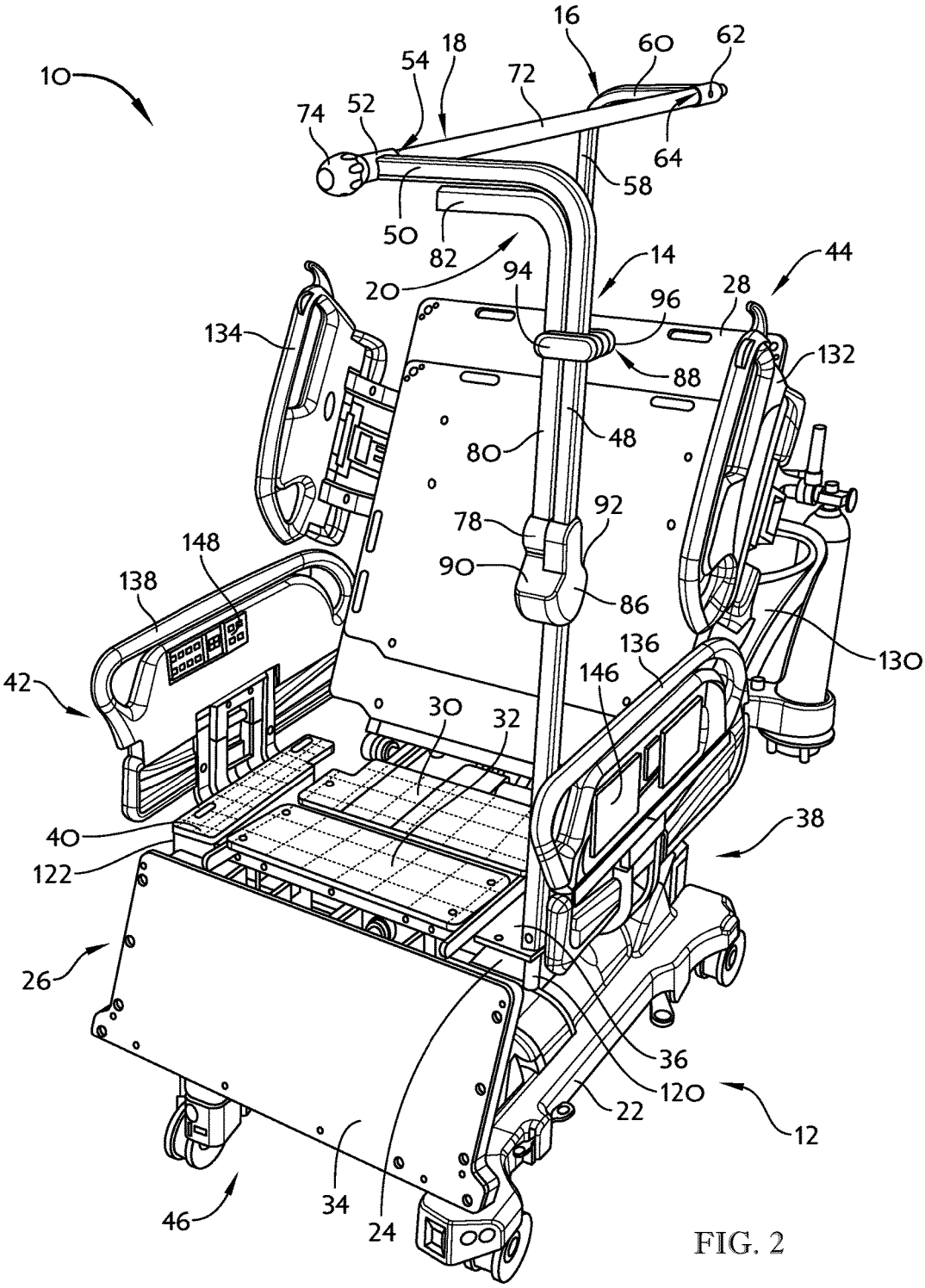
FIG. 2 is a perspective view of the patient helper of FIG. 1 showing the egress handle of the patient helper in a stowed position out of the way of a patient entering or exiting the patient support.
Figure 4:
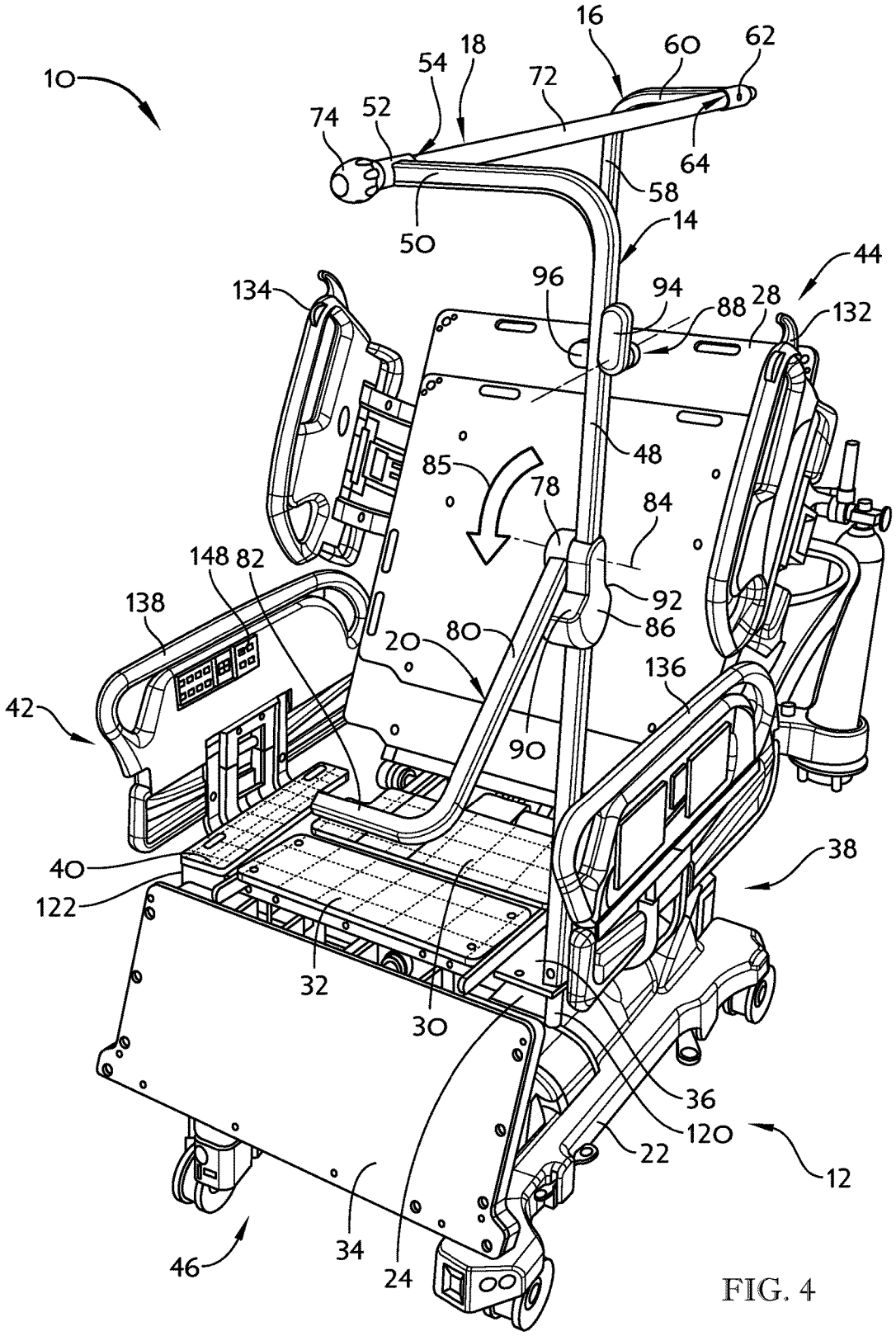
FIG. 4 is a perspective view of the patient helper of FIGS. 1-3 showing the egress handle pivoted about an axis to the assist position.

Egress handle 20 moves between a stowed position, shown in FIG. 2, and an assist position, shown in FIGS. 1 and 4. In the stowed position, egress handle 20 is moved out of the way of a patient supported on bed 12. In the assist position, egress handle 20 provides a support for a patient supported on bed 12 usable to help a patient pull themselves up out of bed 12 to a standing position.

Bed 12 includes a base frame 22, an intermediate frame 24 supported over the base frame 22, and a deck 26 coupled to the intermediate frame 24. The deck 26 includes a head section 28, a seat section 30, a thigh section 32, a foot section 34, a first side deck section 36 extending along a first side 38 of bed 12, and a second side deck section 40 extending along a second side 42 of bed 12. First and second side deck sections 36, 40 are located between a head end 44 and a foot end 46 of bed 12. Head section 28, thigh section 32, and foot section 34 are movable relative to the intermediate frame 24 so that bed 12 is movable between a chair egress position, as shown in FIGS. 1-7, and other known positions. In some embodiments, seat section 30 may be movable relative to intermediate frame 24.

First support tube 14 is L-shaped and has an arm section 48, a boom 50, and a first coupler 52. Arm section 48 extends up from and is coupled to first side deck section 36 along the first side 38 of bed 12. Boom 50 is spaced above first side deck section 36 and extends from arm section 48 toward the second side 42 of bed 12. Arm section 48 and boom 50 are illustratively integrally formed from bent square steel tubing. First coupler 52 is cylindrical and forms a duct 54 extending between the head end 44 and the foot end 46 of bed 12 about mid-way between the first side 38 and the second side 42 of bed 12. First coupler 52 also includes a threaded collar 56 having internal threads.

Second support tube 16 is L-shaped and has an arm section 58, a boom 60, and a second coupler 62. Arm section 58 extends up from and is coupled to intermediate frame 24 at the head end 44 of bed 12 along the second side 42 of bed 12. Boom 60 is spaced above intermediate frame 24 and extends from the second side 42 of bed 12 toward the first side 38 of bed 12. Arm section 58 and boom 60 are illustratively integrally formed from bent square steel tubing. Second coupler 62 is cylindrical and forms a duct 64 extending between the head end 44 and the foot end 46 of bed 12 about mid-way between the first side 38 and the second side 42 of bed 12.

Shaft 18 includes a support section 72, a knob 74, and a threaded section 76 having external threads. Support section 72 of shaft 18 extends through the duct 54 of the first coupler 52 and the duct 64 of the second coupler 62 so that support section 72 is supported above the bed 12 about mid-way between the first side 38 and the second side 42 of bed 12. Threaded section 76 of shaft 18 is configured to engage with threaded collar 56 of first coupler 52 to secure shaft 18 to first support tube 14. Knob 74 is operable to allow a user to turn shaft 18 and to release and engage threaded section 76 of the shaft 18 from threaded collar 56 of first coupler 52.

Egress handle 20 includes a pivot member 78, an arm 80 extending from pivot member 78, and a grip 82. Pivot member 78 is pivotably coupled to the first support tube 14 so that the egress handle 20 pivots about an axis 84 relative to first support tube 14 as suggested by arrow 85 in FIG. 4. Grip 82 extends from arm 80 at about a ninety-degree angle so that egress handle 20 is L-shaped. In other embodiments, the egress handle 20 may bend back on itself or may be a different shape to avoid injuries to a patient falling into the egress handle 20.

Figure 8:
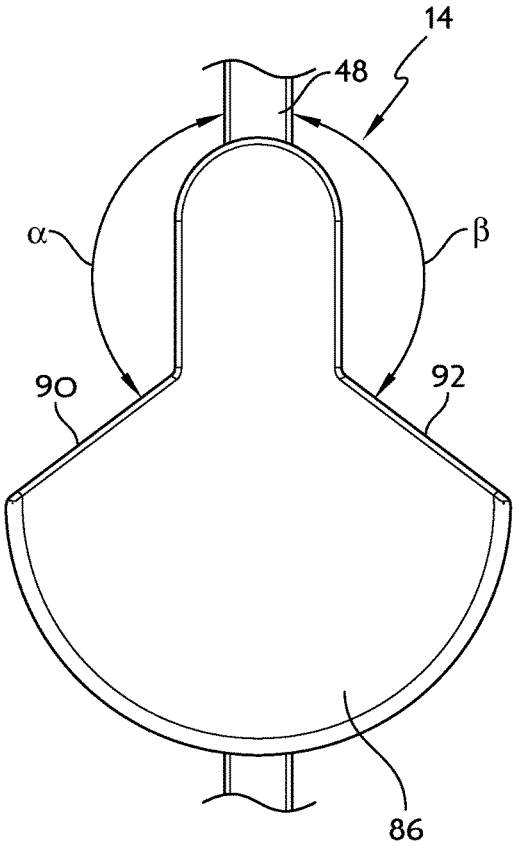
FIG. 8 is a side elevation detail view of a handle positioning block coupled to the first support tube.

Patient helper 10 also includes a handle positioning block 86 and a handle lock 88. Handle positioning block 86 is coupled to first support tube 14 between pivot member 78 of egress handle 20 and bed 12. Block 86 forms a first stop surface 90 and a second stop surface 92. First stop surface 90 extends from the first support tube 14 toward the foot end 46 of bed 12 and forms an obtuse angle α with first support tube 14 as suggested in FIG. 8. Second stop surface 92 extends from the first support tube 14 toward the head end 44 of bed 12 and forms an obtuse angle β with first support tube 14 as suggested in FIG. 8.

Handle lock 88 includes a first tab 94 and a second tab 96. First and second tabs 94, 96 are pivotably coupled to first support tube 14 and pivot about an axis 98 as suggested by arrow 100 in FIG. 3. First and second tabs 94, 96 are independently pivotable in the illustrative embodiment. In other embodiments, first and second tabs 94, 96 may pivot together.

Handle lock 88 is movable between a locked position, blocking movement of egress handle 20 relative to first support tube 14, and a release position, allowing egress handle 20 to pivot relative to first support tube 14. In the locked position of handle lock 88, first tab 94 extends from the first side 38 of bed 12 toward the second side 42 of bed 12 to block movement of egress handle 20 toward the foot end 46 of bed 12. Additionally, second tab 96 extends from the first side 38 of bed 12 toward the second side 42 of bed 12 to block movement of egress handle 20 toward the head end 44 of bed 12. In the release position of handle lock 88, the first tab 94 is pivoted away from the locked position to allow the egress handle 20 to pivot toward the foot end 46 of bed 12 as suggested in FIGS. 3 and 4. In other embodiments, both the first and the second tabs 94, 96 may be pivoted to move the handle lock 88 to the release position.

Figure 7:
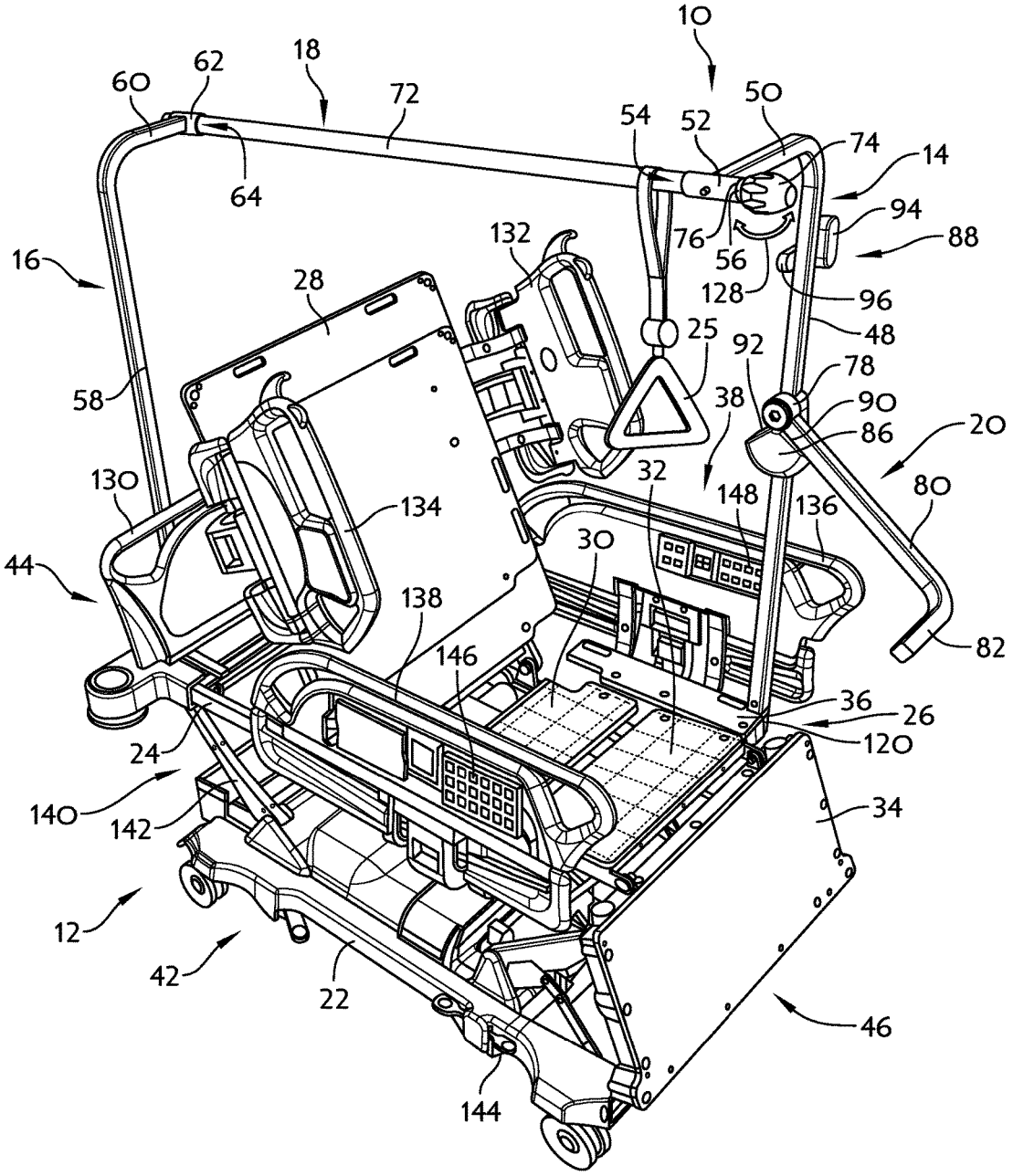
FIG. 7 is a perspective view of the patient helper of the present disclosure coupled to a patient support showing a triangular grab bar hanging down from the shaft of the patient helper over the patient support.

Egress handle 20 is movable between a stowed position, shown in FIG. 2, and an assist position, shown in FIGS. 1, 4, and 7. In the stowed position, the egress handle 20 extends along first support tube 14 and the L-shape of egress handle 20 is nested with the L-shape of the first support tube 14. Also, while in the stowed position, egress handle 20 is located in the footprint of bed 12. Thus, egress handle 20 is stowed out of the way of a patient or caregiver at the bed 12. Further, while egress handle 20 is in the stowed position, the handle lock 88 is moved to the locked position.

In the assist position of the egress handle 20, egress handle 20 is pivoted toward the foot end 46 of bed 12 until the egress handle 20 engages first stop surface 90 of block 86 blocking egress handle 20 from further movement relative to the first support tube 14. Also, while in the assist position, egress handle 20 extends beyond the foot end 46 of bed 12 and outside the footprint of bed 12. Thus, egress handle 20 may be used by a patient to pull herself up from a seated position on the bed 12 to a standing position or onto another patient support. Further, while egress handle 20 is in the assist position, the handle lock 88 is moved to the release position.

Figure 3:
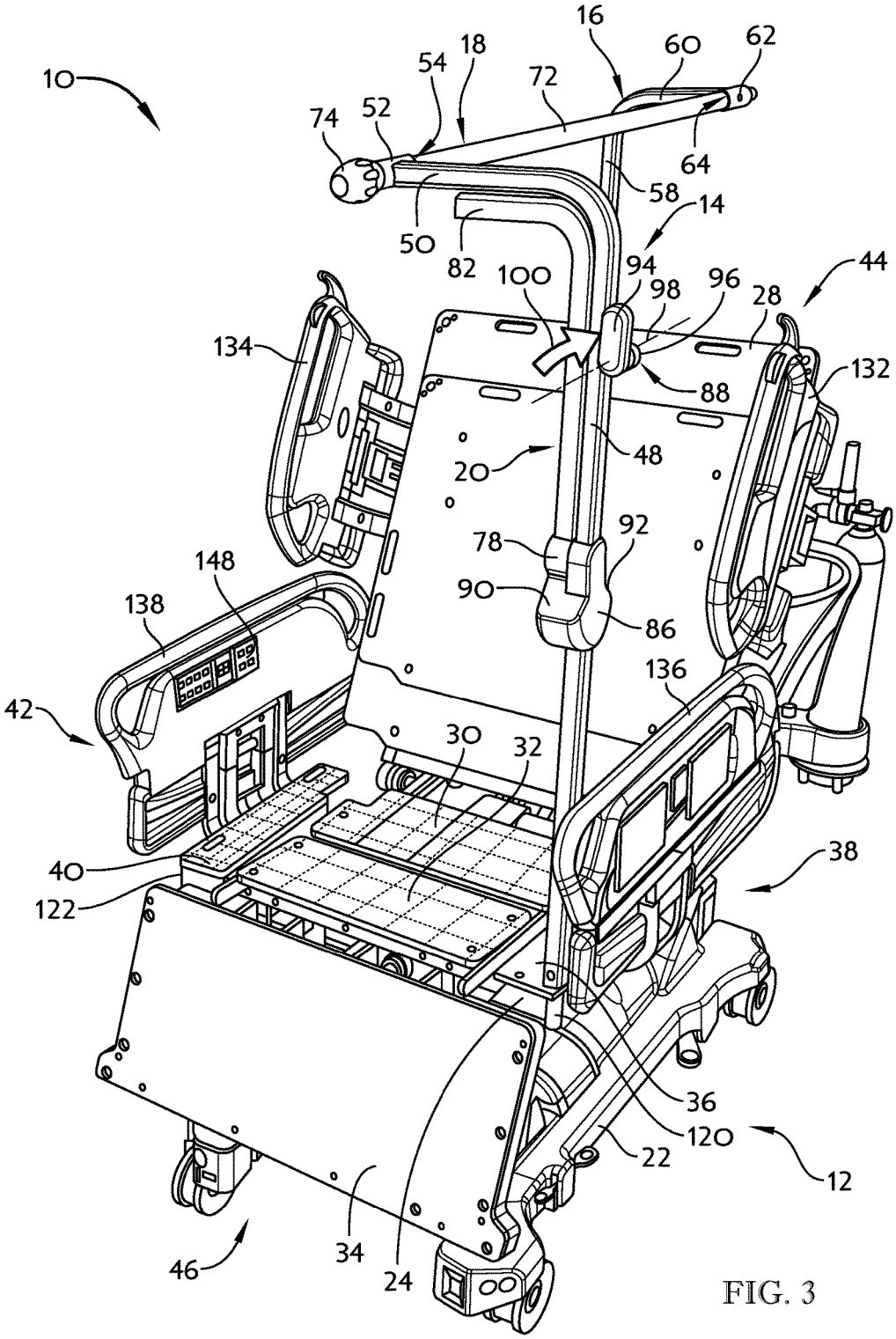
FIG. 3 is a perspective view of the patient helper of FIGS. 1 and 2 showing a handle lock pivoted about an axis to a release position to allow movement of the egress handle.

To move egress handle 20 from the stowed position to the assist position, a user first moves the handle lock 88 from the locked position to the release position by pivoting first tab 94 about axis 98 as suggested by arrow 100 in FIG. 3. Then, a user pivots egress handle 20 toward the foot end 46 of bed 12 about axis 84 as suggested in FIG. 4 until egress handle 20 engages first stop surface 90 of block 86.

First support tube 14 includes a bed coupler 102 with a base 104 and a pin 106. Base 104 is secured to arm section 48 of first support tube 14. Pin 106 extends downwardly from base 104. Second support tube 16 also includes a bed coupler 112 with a base 114 and a pin 116. Base 114 is secured to arm section 58 of second support tube 16. Pin 116 extends downwardly from base 114.

Figure 5:
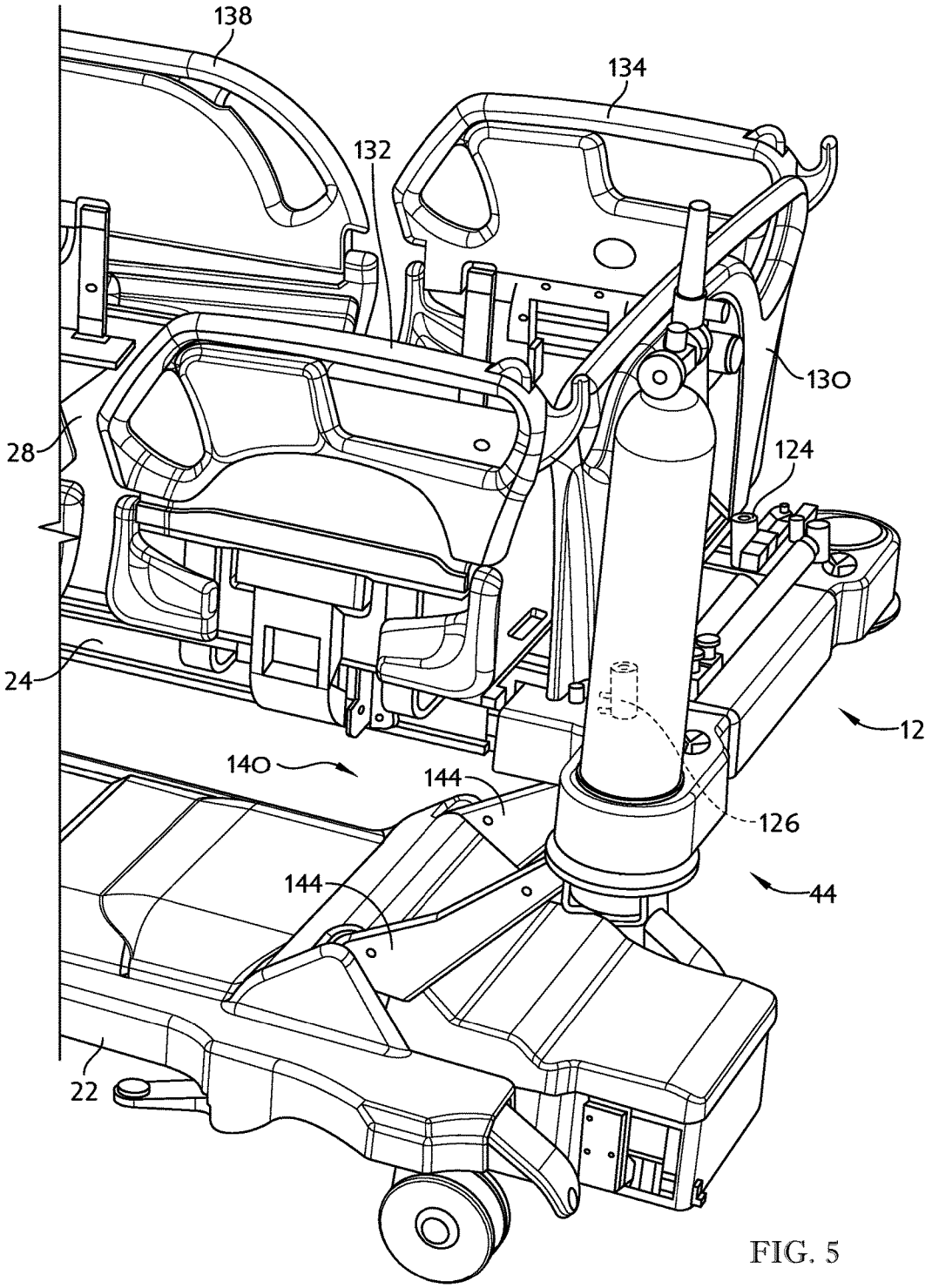
FIG. 5 is a perspective view of the head end of the patient support of FIGS. 1-4 with the patient helper removed to show pin receivers behind a headboard for receiving a second support tube of the patient helper.
Figure 6A:
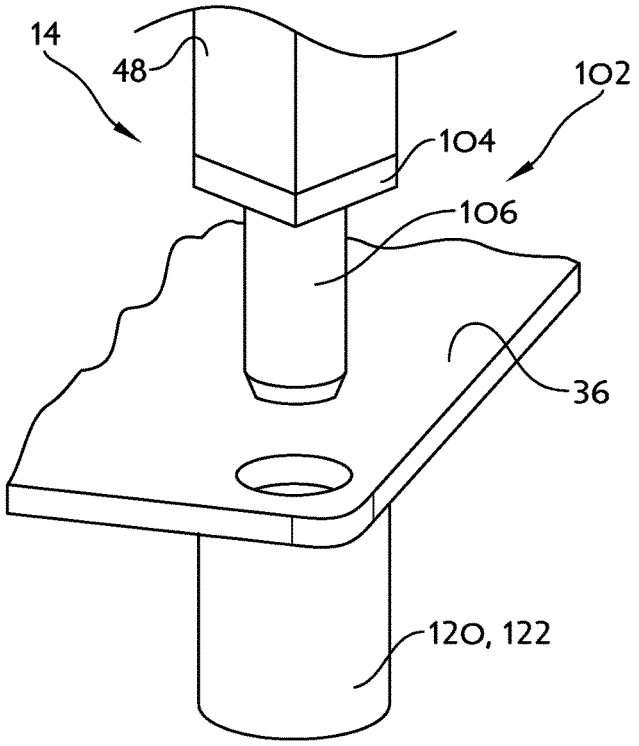
FIG. 6*a* is a detail perspective view of a pin receiver under a side deck section of the patient support along with a bed coupler of a first support tube.
Figure 6B:
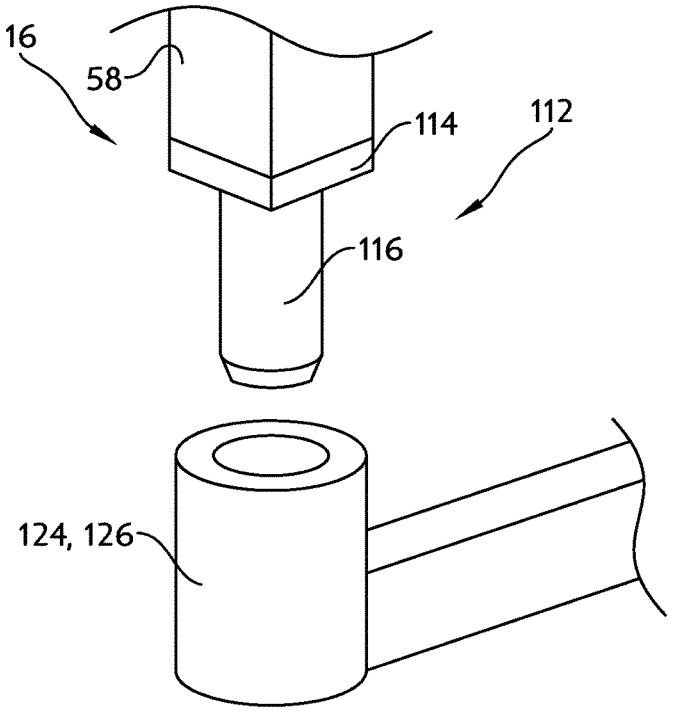
FIG. 6*b* is a detail perspective view of the pin receiver of FIG. 5 along with a bed coupler of the second support tube.

Intermediate frame 24 includes a plurality of pin receivers 120, 122, 124, 126. Pin receivers 120, 122, shown in FIGS. 2-4 and 6*a*, are located below side deck sections 36, 40 and are sized to receive pin 106 of first support tube 14. Pin receivers 124, 126, shown in FIGS. 5 and 6*b*, are located along the head end 44 of bed 12 at the first side 38 and the second side 42 of bed 12, respectively. Pin receivers 124, 126 are sized to receive pin 116 of second support tube 16.

Patient helper 10 is movable between a right entry position, allowing patient entry to the bed 12 from the right side of bed 12 and a left entry position, allowing patient entry to bed 12 from the left side of bed 12. Patient helper 10 is illustratively shown in the right entry position. In the right entry position, patient helper 10 is coupled to bed 12 and pin 106 of first support tube 14 extends through first side deck section 36 and into pin receiver 120. Also, pin 116 of second support tube 16 extends into pin receiver 126. Thus, first support tube 14 and second support tube 16 are spaced diagonally from one another relative to bed 12 as suggested in FIG. 1. Further, first support tube 14 blocks a patient from entry or exit from the bed 12 at the first side deck section 36, illustratively on a patient's left side, but allows entry or exit from the bed 12 at the second side deck section 40, illustratively on a patient's right side.

In the left entry position (not shown), patient helper 10 is coupled to bed 12 and pin 106 of first support tube 14 extends through second side deck section 40 and into pin receiver 122. Also, pin 116 of second support tube 16 extends into pin receiver 124. Thus, first support tube 14 and second support tube 16 are again spaced diagonally from one another relative to bed 12. Further, first support tube 14 blocks a patient from entry or exit from the bed 12 at the second side deck section 40, illustratively on a patient's right side, but allows entry or exit from the bed 12 at the first side deck section 36, illustratively on a patient's left side. In other embodiments, first support tube 14 and second support tube 16 may be arranged on the same side of bed 12 in both the right and left entry positions.

To move the patient helper 10 between the right entry position and the left entry position, a user rotates knob 74 as suggested by arrow 128 in FIG. 7 to disengage threaded section 76 of shaft 18 from threaded collar 56. Then, a user slides shaft 18 out of first coupler 52 and second coupler 62. Next, a user lifts pin 106 of first support tube 14 from pin receiver 120 and drops pin 106 of first support tube 14 into pin receiver 122 situating first support tube 14 so that boom 50 of first support tube 14 extends from the second side 40 of bed 12 toward the first side 38 of bed 12. Then a user lifts pin 116 of second support tube 16 from pin receiver 126 and drops pin 116 of second support tube 16 into pin receiver 124 situating second support tube 16 so that boom 60 of second support tube 16 extends from the first side 38 of bed 12 toward the second side 40 of bed 12. Then a user slides shaft 18 through first coupler 52 and second coupler 62. Finally, a user engages threaded section 76 of shaft 18 with threaded collar 56 of first coupler 52 by rotating knob 74.

As would be apparent to one of ordinary skill in the art, when the patient helper 10 is in the right entry position functions of the handle positioning block 86 and handle lock 88 are reversed. For example, egress handle 20 engages the second stop surface 92 of block 86 when egress handle 20 is in the assist position. Additionally, second tab 96 of handle lock 88 is pivoted to move the handle lock 88 between the locked and release positions.

Bed 12 also includes a headboard 130, head rails 132, 134, and siderails 136, 138 extending around deck 26 to block unwanted patient exit from bed 12. Siderails 136, 138 are movable between a raised position, shown in FIGS. 1-5 and 7, and a lowered position for allowing a patient to exit along the first side 38 or the second side 42 of bed 12.

Bed 12 further includes a lift system 140 with arms 142, 144. Lift system 140 extends between base frame 22 and intermediate frame 24. Lift system 140 is operable to raise and lower intermediate frame 24 relative to base frame 22.

Siderails 136, 138 include user inputs 146, 148 located for use by a patient or a caregiver. User inputs 146, 148 are operable to direct the deck 26 to move from the chair egress position to other known positions, such as a flat bed position and a reclined position. User inputs 146, 148 are also operable to direct lift system 140 to raise and lower the intermediate frame 24 relative to base frame 22.

FIGS. 9-12 show an alternative patient helper 310 with an alternative shaft 318, an alternative first coupler 352, and an alternative second coupler 362. Alternative patient helper 310 is substantially similar to patient helper 10 described above and like features are numbered similarly. Also, patient helper 310 is configured for use with the patient support 12 and egress handle 20 as described above.

Figure 9:
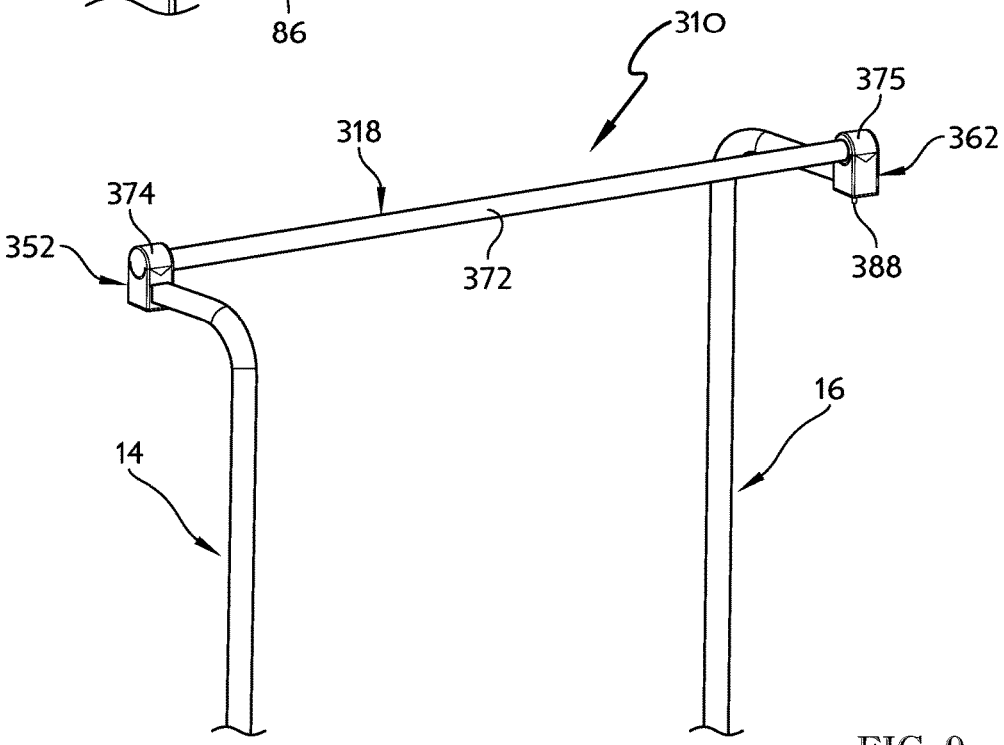
FIG. 9 is a perspective view of an alternative patient helper apparatus with an alternative first coupler, second coupler, and shaft.
Figure 10:
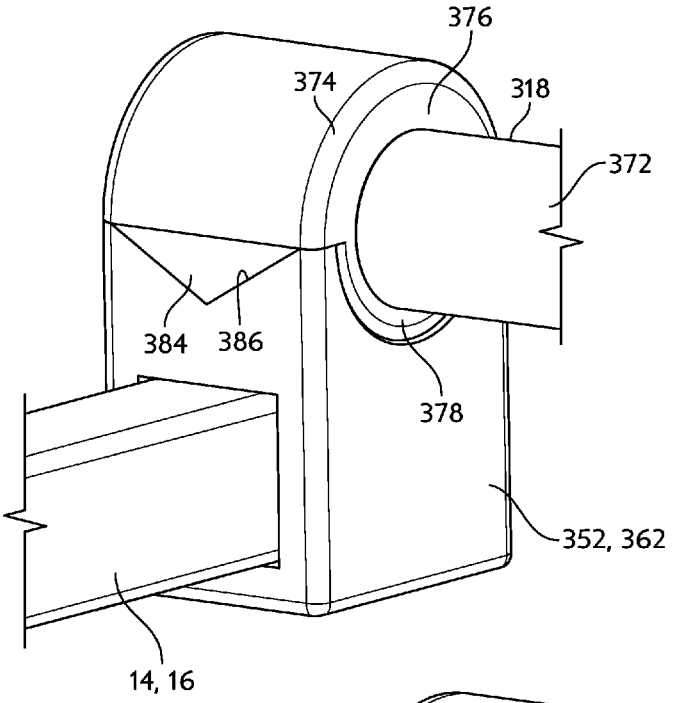
FIG. 10 is a perspective detail view of the alternative first coupler and alternative shaft.

Shaft 318 is supported by first and second couplers 352, 362, as shown in FIG. 9 so that the shaft 318 is situated above the patient support 12 as described above. First and second couplers 352, 362 can be secured to shaft 318 to hold shaft 318 in place over patient support 12.

Figure 11:
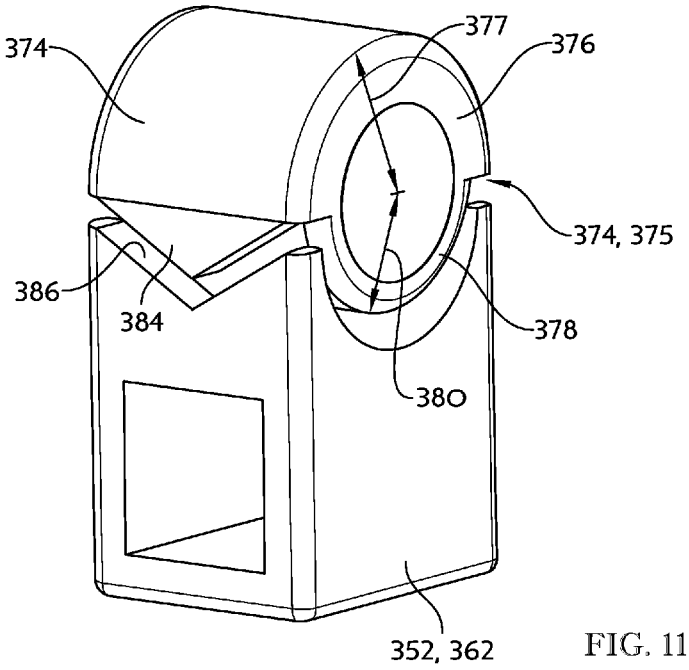
FIG. 11 is a perspective detail view of the alternative first coupler and a shaft support collar.
Figure 12:
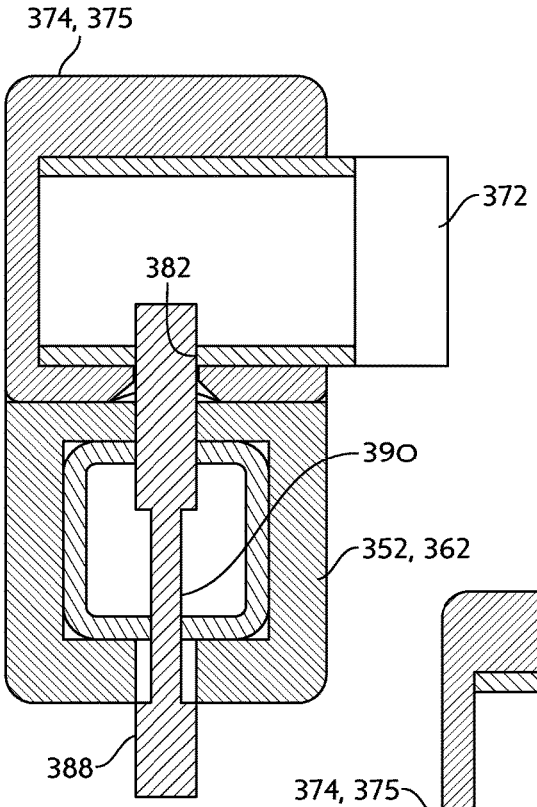
FIG. 12 is a cross-sectional view of the alternative first coupler and shaft in a shaft locked position.

Shaft 318 includes a support section 372, a first shaft support collar 374, and a second shaft support collar 375. First and second shaft support collars 374, 375 extend around support section 372 at opposing ends of support section 372. First and second shaft support collars 374, 375 each have a top portion 376 with a first outer diameter 377 and a bottom portion 378 with a second outer diameter 377, smaller than the first diameter 378, as shown in FIG. 11. The bottom portion 378 also includes a threaded hole 382 and wedges 384. The wedges 384 are illustratively V-shaped and extend beyond the second diameter 380.

First and second couplers 352, 362 are coupled to first support tube 14 and second support tube 16, respectively. First and second couplers 352, 362 each form cradles 386 and include lockdown bolts 388. Cradles 386 are configured to receive and engage the bottom portion 378 of the first and the second shaft support collars 374, 375.

Figure 13:
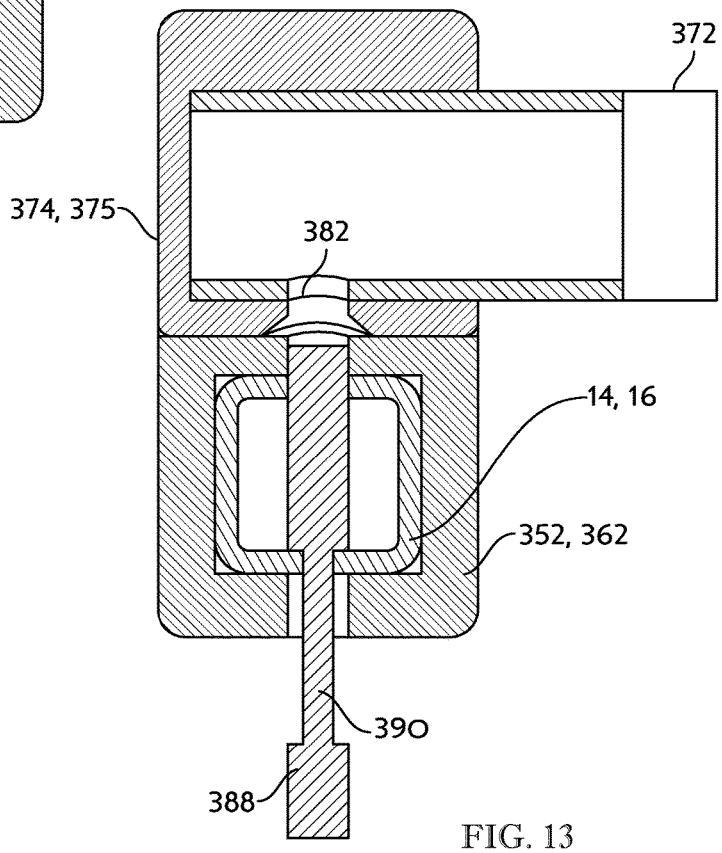
FIG. 13 is a cross sectional view of the alternative first coupler and shaft in a shaft release position.

Lockdown bolt 88 of the first coupler 352 extends through the first support tube 14 and includes an undercut section 390 that prevents removal of the lockdown bolt 388 from the first support tube 14 as suggested in FIG. 13. Lockdown bolt 88 of the second coupler 362 extends through the second support tube 16 and includes an undercut section 390 that prevents removal of the lockdown bolt 388 from the second support tube 16 as suggested in FIG. 13.

When bottom portions 378 of first and second shaft support collars 374, 375 are received in cradles 354 of first and second couplers 352, 362, the larger first diameter 378 of the top portion 376 of the collars 374, 375 blocks the shaft 318 from rotating and the wedges 384 of the collars 374, 375 block the shaft from sliding relative to the first and the second couplers 352, 362. Additionally, when the bottom portions 378 are received in the cradles 354, the threaded holes 382 of the first and second collars 374, 375 are aligned with the lockdown bolts 388 of first and second couplers 352, 362.

Lockdown bolts 388 of first and second support collars 374, 375 are movable between a locked and an unlocked position. In the locked position, shown in FIG. 12, lockdown bolts 388 engage the threaded holes 382 of the first and the second collars 374, 375 thereby securing the first and second collars 374, 375 to the first and second couplers 352, 362, respectively. In the unlocked position, shown in FIG. 13, lockdown bolts 388 are disengaged from the threaded holes 382 of first and the second collars 374, 375 thereby releasing the first and second collars 374, 375 from the first and second couplers 352, 362, respectively. Lockdown bolts 388 of first and second support collars 374, 375 are moved between a locked and an unlocked position by a user turning a T-handle or knob (not shown) coupled to lockdown bolts 388.

Although certain illustrative embodiments have been described in detail above, variations and modifications exist within the scope and spirit of this disclosure as described and as defined in the following claims.

The invention claimed is:

1. A patient support apparatus comprising a base frame, an intermediate frame supported above the base frame, a patient support deck including a plurality of deck sections at least some of which are movable to support a patient in multiple positions, the plurality of deck sections including a seat section to support buttocks of the patient and a thigh section to support thighs of the patient, the thigh section being movable relative to the intermediate frame, and an accessory frame attachment apparatus that comprises a pin receiver situated beneath a first deck section of the plurality of deck sections, the first deck section having an opening formed therethrough and located within an outer periphery of the deck section and though which the pin receiver is accessible for receipt of a pin of an accessory frame, the first deck section being situated alongside the seat section and the thigh section, the first deck section remaining stationary relative to the intermediate frame as the thigh section moves relative to the intermediate frame.

2. The patient support apparatus of claim 1, wherein the first deck section is anchored to the intermediate frame.

3. The patient support apparatus of claim 1, wherein the seat section is movable relative to the intermediate frame while the first deck section remains stationary relative to the intermediate frame.

4. The patient support apparatus of claim 1, wherein the plurality of deck sections comprises a foot section that supports lower legs of the patient, the first deck section is situated between the foot section and a head end of the intermediate frame.

5. The patient support apparatus of claim 4, wherein the foot section has a lateral width that is greater than a lateral width of the thigh section.

6. The patient support apparatus of claim 1, wherein the pin receiver is oriented vertically.

7. The patient support apparatus of claim 1, wherein the first deck section has a corner region and the pin receiver is located beneath the corner region.

8. The patient support apparatus of claim 1, wherein the pin receiver is cylindrical in shape.

9. The patient support apparatus of claim 8, wherein the opening of the first deck section is circular in shape.

10. The patient support apparatus of claim 1, further comprising an accessory frame arm having a pin that extends through the opening of the first deck section into the pin receiver.

11. The patient support apparatus of claim 10, wherein the accessory frame arm extends substantially vertically when the pin is received in the pin receiver.

12. The patient support apparatus of claim 10, further comprising a siderail coupled to the intermediate frame and extending alongside the first deck section, the accessory frame arm extending upwardly adjacent to the siderail.

13. The patient support apparatus of claim 10, wherein the accessory frame arm has a base that rests upon the first deck section when the pin is received in the pin receiver.

14. The patient support apparatus of claim 10, further comprising a grip handle that is coupled to the accessory frame arm, the grip handle being configured to gripped by the patient when exiting the patient support apparatus.

15. The patient support apparatus of claim 14, wherein the grip handle is arranged to be gripped by the patient when the exiting the patient support apparatus when the patient support deck is in a chair egress position.

16. The patient support apparatus of claim 14, wherein the grip handle is movable relative to the accessory frame arm between a use position and a storage position.

17. The patient support apparatus of claim 1, wherein the pin receiver comprises a first pin receiver and further comprising a second pin receiver coupled to the intermediate frame and spaced apart from the first pin receiver.

18. The patient support apparatus of claim 17, wherein the first pin receiver is located adjacent a foot end of the intermediate frame and the second pin receiver is located adjacent a head end of the intermediate frame.

19. The patient support apparatus of claim 1, wherein the seat section has a lateral width that is greater than a lateral width of the first deck section.

20. The patient support apparatus of claim 1, wherein the thigh section has a lateral width that is greater than a lateral width of the first deck section.

* * * * *